US005284277A

United States Patent [19]

Leuenberger

[11] Patent Number: 5,284,277

[45] Date of Patent: Feb. 8, 1994

[54] TWO-PART CAPTIVE DISPENSING CAP DEVICE FOR USE WITH A CONTAINER OR THE LIKE

[75] Inventor: Gerhard Leuenberger, Oberrieden, Switzerland

[73] Assignee: S. Kisling & Cie. AG, Zurich, Switzerland

[21] Appl. No.: 565,603

[22] Filed: Aug. 10, 1990

[30] Foreign Application Priority Data

Aug. 11, 1989 [CH] Switzerland ..... 2952/89

[51] Int. Cl.[5] ..... B67D 3/00

[52] U.S. Cl. ..... 222/521

[58] Field of Search ..... 222/48, 521, 549

[56] References Cited

U.S. PATENT DOCUMENTS

| | | | |
|---|---|---|---|
| 2,998,902 | 9/1961 | Thomas et al. | 222/499 |
| 3,010,619 | 11/1961 | Gronemeyer et al. | 222/521 |
| 3,131,836 | 5/1964 | Van Baarn | 222/521 |
| 3,216,630 | 11/1965 | Stull | 222/549 |
| 3,278,096 | 10/1966 | Miller | 222/549 |
| 4,438,870 | 3/1984 | Stull | 222/521 |
| 4,477,002 | 10/1984 | Stull | 222/521 |
| 4,690,304 | 9/1987 | Morel | 222/521 |
| 4,867,354 | 9/1989 | Schreiber | 222/521 |
| 4,892,710 | 1/1990 | Wong et al. | 222/530 |
| 4,964,537 | 10/1990 | Dubach | 222/549 |

FOREIGN PATENT DOCUMENTS

| | | | |
|---|---|---|---|
| 78209593 | 3/1988 | China . | |
| 78211082 | 4/1989 | China . | |
| 0187567 | 7/1980 | European Pat. Off. . | |
| 0296103 | 6/1988 | European Pat. Off. . | |
| 3727789 | 3/1981 | Fed. Rep. of Germany . | |
| 2555551 | 5/1985 | France . | |
| 2600978 | 1/1988 | France . | |
| 943452 | 12/1963 | United Kingdom | 222/521 |

*Primary Examiner*—Kevin P. Shaver
*Assistant Examiner*—Kenneth Bomberg
*Attorney, Agent, or Firm*—Egli International

[57] ABSTRACT

A seal is provided comprising two parts and is made of synthetic material. An upper part has an internal thread, a continuous surface area and an axial external cylinder section. A valve tube is positioned above the cylinder section and is held in place by means of a conical intermediate piece. A lower part has an external thread, a continuous surface area and an axial internal cylinder section. A sealing bulge faces the external cylinder section and a valve pin held in place above it by means of connecting bars. By turning the upper part in relation to the lower part, the upper part is displaced axially in relation to the lower part. A sealing piece is fitted axially to the upper end of the valve pin. As the seal is screwed down, the sealing piece blocks the upper opening of the upper part. Its upper end is flush with or rising above the upper part, and the valve pin is enclosed by the valve tube. When the seal is screwed down on entirely the valve pin will be located outside the valve tube. A rib at the lower part and a baffle at the upper part cooperate to limit the rotation of the upper part in relation to the lower part to less than a full revolution.

7 Claims, 8 Drawing Sheets

TWO-PART CAPTIVE DISPENSING CAP DEVICE FOR USE WITH A CONTAINER OR THE LIKE

BACKGROUND OF THE INVENTION

The present invention relates to a two-part seal made of synthetic material for a receptacle containing a free-flowing substance.

More specifically, the present invention relates to a two-part cap device or seal (herein referred to as a cap device or seal) made of synthetic material for a receptacle containing a free-flowing substance, with a lower part that can be slid onto the receptacle and that is in essence rotationally symmetrical around an axis of the cap device, its lower range being equipped with an external thread and an organ for attaching at the receptacle and at a lower and an upper end being provided with one opening each and possessing a non-perforated surface area between these openings, an upper part essentially symmetrical around the axis of the cap device, which in its lower range is provided with an internal thread suited for the external thread and at a lower and an upper end is provided with one opening each and possesses a non-perforated surface area between these openings, a valve pin directed upwards axially at the lower part and held via connecting bars, a valve tube, located axially at the upper part by means of an essentially conical intermediate piece, the internal thread being effectively connected with the external thread in the mounted state of the cap device so that the valve pin may be displaced axially in relation to the valve tube by turning the upper part in relation to the lower part, one cylinder section each located axially at the lower part and at the upper part, and a sealing bulge located at one of the cylinder sections and facing the other cylinder section, the two cylinder sections forming, when the seal is mounted, a tight effective connection by means of the sealing bulge and embracing each other coaxially at least over a part of their lengthwise extension, so that while continuously in a sealing state the two cylinder sections may be displaced axially in relation to each other.

A seal of the kind mentioned at the outset is known from DE-A-3727789 which renders possible a proportioned discharge of the fluid contents of the receptacle. The disadvantage of this seal is the fact that it contains a dead space which is not rinsed by the fluid when it is discharged. Parts of the fluid may remain there for longer periods of time, which cannot be tolerated in particular for fluids of limited storage times, e.g. because of spontaneous solidification or other changes, which may be the case for example with single-package systems, fats, foodstuffs, etc. It is a further disadvantage of this seal that it has a pour-out area where after the fluid discharge has been concluded a fluid residue will remain which then will be exposed to the outside air for an extended period of time. This in turn cannot be tolerated with fluids that will solidify when in contact with the outside air or liable to change in any other way, for example single-package systems which solidify when exposed to air, fats which turn rancid, or foodstuffs which will dry out.

From EP-A-0296103 a seal is known that is equipped with a stopping element that stops up the upper opening of the upper part in the closed state of the seal. This is to prevent the existence of an area where a fluid residue will remain after the fluid discharge has been concluded, which in consequence will be exposed to outside air for longer periods of time. The disadvantage of this system is that after the conclusion of the fluid discharge there will still be a drop of fluid bridging the upper opening of the upper part and the stopping element, especially if the fluid is so viscous that even a big drop may not be removed by shaking it down. The seal according to EP-A-0296103 is dirtied and/or pasted up by this drop. Moreover, the seal according to EP-A-0296103 possesses a dead space which is not rinsed when the fluid is discharged. In addition, the seal according to EP-A-0296103 is equipped with rated break points or flexible parts and thus its production is rather costly.

It is an object of the present invention to create a seal of the kind mentioned at the outset having no dead space which is not rinsed by the fluid when it is discharged and no discharge area which might make possible the remaining of a fluid residue exposed to outside air after the conclusion of the fluid discharge, furthermore which does not allow the formation of a drop bridging the upper opening of the upper part, and which also may be produced at low cost.

SUMMARY OF THE INVENTION

An object of the present invention is accomplished, according to the invention, by a seal having the combination of features specified.

The present invention provides a two-part captive dispensing cap device for use with a container, which comprises a lower part slidable onto a receptacle and rotationally symmetrical about a longitudinal axis of the cap device. A lower portion of the lower part has an inner side and an outer side where the outer side includes a plurality of external threads and an organ which attaches to the receptacle. The lower part defines a substantially central longitudinal aperture therethrough and includes an upper end and a lower end each having an opening communicating with the longitudinal aperture. The lower part further includes a non-perforated surface area extending between the upper and lower ends consistent with the longitudinal aperture and substantially centered about the longitudinal axis of the cap device.

The cap device further comprises an upper part substantially symmetrical around the axis of the cap device and including a lower portion having an inner side and an outer side. The inner side has a plurality of internal threads designed and configured for mating with the external threads of the lower part. The upper part further defines a longitudinal aperture which extends therethrough and is substantially central about the longitudinal axis of the cap device. The upper part includes an upper end and a lower end each having an opening communicating with the longitudinal aperture. The upper part includes a non-perforated surface area between the upper and lower ends along the outer side of the lower portion of the upper part. A valve pin extends substantially upwards from the upper end of the lower part and is positioned about the longitudinally axis of the cap device. The valve pin is held in a substantially stationary position by at least two connecting bars coupled at one end to the valve pin and at an opposite end connected proximal the upper end of the lower part.

A valve tube extends substantially upwards from the upper end of the upper part and is positioned about the longitudinal axis of the cap device. The valve tube is integral with an intermediate conical portion attached to the upper end of the upper part. The internal threads of the upper part cooperate with the external threads of the lower part when the upper part and lower part are in a mounted state. When int he mounted state the valve pin cooperates with the valve tube such that the valve pin is displacable axially in relation to the valve tube by turning the upper part in relation to the lower part.

An upper cylinder section is positioned about the longitudinal axis of the cap device and between the lower end and the upper end of the upper part. The cylinder section is integral with the lower end of the upper part and integral with the intermediate conical portion of the upper part.

A lower cylinder section is positioned about the longitudinal axis of the cap device and between the lower end and the upper end of the lower part.

A sealing bulge positioned about the upper end of the lower part and substantially continues circumferentially about the upper end. The sealing bulge extends radially outward towards an inner side of the cylinder section of the upper part when the upper and lower parts are in a mounted state.

The sealing bulge of the lower part substantially communicates with the inner side of the cylinder section of the upper part when the upper and lower parts are mounted. Thus, when the upper and lower parts are mounted a substantial seal is provided continuously along the cylinder section of the upper part when the cylinder sections are displaced axially in relation to each other.

The upper part and the lower part communicate such that the internal threads of the upper part and the external threads of the lower part cooperate. Thus, the upper part rotates about the lower part and the upper part elevates itself or lowers itself in relation to the lower part.

When the upper part is in an elevated position in relation to the lower part the upper ends of the upper part cylinder section and the lower part cylinder section are essentially facing each other from a level position.

When the upper part is in its lowest position respective to the lower part the valve tube and the valve pin substantially communicate along their respective lengths.

When the upper part is at a most elevated position with respect to the lower part the valve pin is located outside the valve tube.

A sealing piece is positioned at an upper end of the valve pin axially about the valve pin. When the upper part is mounted on the lower part and when the upper part is in its lowest position relative to the lower part the sealing piece is introduced into the upper part of the valve tube.

More specifically, this object is accomplished, according to the invention, in that in the mounted state of the cap device the inner cylinder section will be located in the middle range of the lower part between the external thread and the valve pin, in the mounted state of the seal the outer cylinder section will be located in the middle range of the upper part between the internal thread and the valve tube, the sealing bulge is essentially fitted to an upper end of the inner cylinder section and directed radially outwards, while in the mounted state of the cap device and with it being fully screwed-on, the upper ends of the two cylinder sections are essentially facing each other from a level position, the valve pin is being held by means of the connecting bars at the inner cylinder section and above from it, the valve tube is being held by means of the essentially conical intermediate piece at the outer cylinder section and above from it, in the mounted state of the seal and if it is fully screwed-on the valve pin is enclosed coaxially by the valve tube essentially on the entire length of the valve tube, in the mounted state of the seal and if it is fully unscrewed the valve pin will be located essentially outside the valve tube, and a sealing piece is provided which is fitted axially onto the upper end of the valve pin as its extension, while in the mounted state of the seal and if it is fully screwed-on the sealing piece is introduced into the upper opening of the upper part and stops it up.

Preferably, the valve pin and the valve tube are both truncated and, when considered in the mounted state of the seal, are tapering towards the upper opening of the upper part, the valve pin having a more acute cone angle than the valve tube, and that in the mounted state of the seal and if it is fully screwed-on the valve pin is located at a distance from the valve tube.

Preferably, the sealing piece is longer than a predetermined thickness of the upper part at whose upper end in the range of its upper opening, and in the mounted state of the seal and if it is fully screwed-on, an upper end of the sealing piece rises axially above the upper end of the upper part by a predetermined projecting height.

Preferably, a rib is located at the lower part parallel to the axis and at a distance from it and directed radially inward, and a baffle is located at the upper part parallel to the axis and at a distance from it and directed downward, the rib and the chicane acting jointly in the mounted state of the seal in order to limit the possible rotation of the upper part relative to the lower part, by means of stopping each other, to a certain twisting angle which is smaller than a full revolution. In this case, preferably, the lower part is equipped with a cam located parallel to the axis and at a distance from it and directed radially inward which, in the mounted state of the seal and if it is in a position between being fully screwed-on and at the most one-fourth unscrewed, acts jointly with the baffle in order to surmountably impede a rotation of the upper part in relation to the lower part against the action of the elasticity of the material.

Preferably, in the mounted state of the cap device and if it is unscrewed down to the stop the diameter of the sealing piece is greater by 0.01 to 0.25 mm than the diameter of the upper opening, and the material of the synthetic material in regard to its elasticity is chosen as such that the sealing piece may be introduced into the upper opening against the action of the elasticity of the material.

Preferably, at least one mark is located at the outside of the lower part essentially at its lower end and at least one mark is located at the outside of the upper part at least in the vicinity of its lower end. In this case, preferably, at least one mark is developed as embossed pattern, or, also preferably, as element protruding radially outward.

Also in this case, preferably, in the mounted state of the seal and if it is screwed-on down to the stop at least one of the marks each, located at the lower part and at the upper part, will be facing each other.

Preferably, the sealing bulge is designed as swelling fitted onto the inner cylinder section.

Preferably, an external wall of the valve tube is designed as standard cone. In this case, preferably, the standard cone is a Luer cone.

The cap device, according to the invention, consists of two parts and is in essence rotationally symmetrical so that it may be produced at low cost. Since valve pin and valve tube are developed in a truncated shape with different cone angles and at a distance from each other, the seal's ability to proportion the fluid by rotation is improved in comparison with known seals, in particular the adjustment of the dosage is more gradual.

The two cylinder sections guarantee the sealing of the upper part in relation to the lower part with the help of the sealing bulge. When the seal is open the fluid is flowing within the conical intermediate piece past the connecting bars. When the seal is fully screwed-on the cylinder sections are located in the middle range of the seal between the thread and the valve and the upper ends of the cylinder sections are approximately facing each other in the proximity of the lower end of the conical intermediate piece. Because of this arrangement and since the sealing bulge is essentially fitted to the upper end of the inner cylinder section there is essentially no dead space in the seal according to the invention.

The preferred embodiment of the sealing bulge as swelling stiffens it a lot, thus further improving the sealing.

When screwing on the cap device, the upper opening of the upper part is stopped up by the sealing piece. If the sealing piece is dimensioned as such that its upper end will lie about flush with the upper opening of the upper part, the substance which is ejected by the sealing part from the upper part when screwing on the seal will form a residue in this place in the shape of a swelling that—even if it solidifies —may be removed easily by the user by means of the finger tip or the nail. If in another preferred alternative the sealing piece is introduced not only in the upper opening of the upper part but pushed on further through the upper part, when the seal is screwed tight, so that its upper end rises above the upper part in the fully screwed-on state of the seal, then the fluid remaining in the range of the upper opening is pushed away and only a small residue can remain there and solidify. In any case the formation of a solidifying clot is not possible.

Besides, the sealing part braces the upper opening of the upper part against the elasticity of the synthetic material, when it is introduced into the upper opening of the upper part, for its diameter is greater than that of the opening if the seal is unscrewed. This causes a self-cleaning of the upper opening and an improvement of the sealing.

Through the joint action of the baffle and the rib the rotation of the seal is limited to the tolerated measure. On the one hand, theoseal cannot open up, so that no uncontrolled fluid discharge may occur, which would be very dangerous for the persons standing nearby in the case of cyanoacrylate adhesives. On the other hand the determination of the twisting angle and of the two final positions of the seal render it possible to dimension the various parts of the seal so exactly that when unscrewing, the sealing piece continually releases the opening of the seal and the valve tube, thus guaranteeing optimum proportioning sensitivity, and that in the screwed-on final position it will come to rest precisely opposite the upper part, having the previously specified advantages.

The joint action of baffle and rib also renders it possible to apply marks at both parts of the seal that make it feasible for the user to adjust the dosage exactly and repeatably.

Furthermore, the joint action of the baffle and the cam located at the rib renders it possible to slightly brake or hold the seal in its screwed-on final position or near it, for example throughout a first quarter rotation of the unscrewing process. On the one hand this measure has the advantage that an undesired spontaneous or accidental unscrewing is prevented. On the other hand, this measure has the advantage that the initial unscrewing is braked so that the gases in the receptacle cannot escape abruptly, which reduces the hazard of splashes of for example cyanoacrylate adhesive getting into the eyes of the user.

Since the cap device according to the invention is opened and closed by rotation and cleans itself, its point does not need to be accessible, which makes it possible to develop the valve tube at the outside as a Luer cone, thus forming a standard connecting piece to which hoses, needles, etc. may be connected with great ease.

If the cap device according to the invention is applied to a receptacle which is dimensioned in a way that it can be held by hand, a significant advantage of the invention consists in that the seal may be opened and closed by thumb and forefinger of the same hand that is holding the receptacle, i.e. the seal according to the invention facilitates single-handed operation. The other hand remains free, for example for the holding of parts when doing gluing work.

In the following an embodiment of the invention is explained in greater detail by means of the drawing.

DETAILED DESCRIPTION OF THE PREFERRED EMBODIMENTS

In the exemplary embodiment of the invention described in the following, simultaneous reference is made to all figures because of the combined action of the parts, same parts being designated with the same reference signs in all figures. In a global view of the two-part cap device in the mounted state as seen from the front or the top, the lower part of the cap device would be almost entirely covered by the upper part. For this reason reference is made to FIG. 7, 8 and 9 for the representation of both cap device, which show a longitudinal section of the cap device in its screwed-on and unscrewed state and in addition an upper part of a receptacle in FIG. 9.

It is the object of the cap device according to the invention to act jointly with a receptacle containing a free-flowing substance, either as to provide a tight sealing of the receptacle or in order to permit the discharge of the free-flowing substance from the receptacle by way of the seal, for example by means of the pressure of a gas or the force of a piston upon the receptacle, if it is rigid, or by squeezing of a flexible receptacle by hand.

Figure 2:
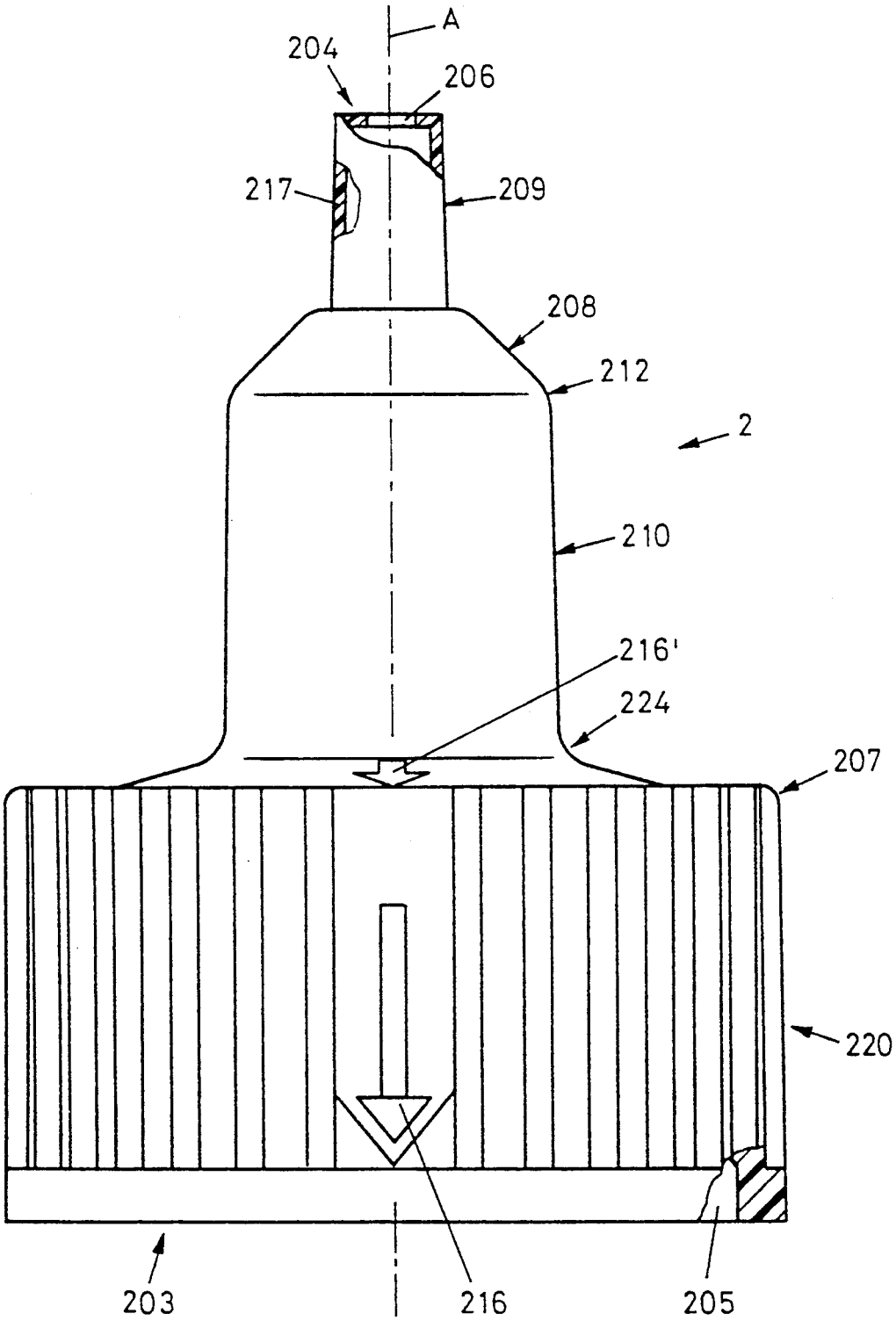
FIG. 2 shows an upper part of the seal according to the invention in a partly sectional front view.
Figure 3:
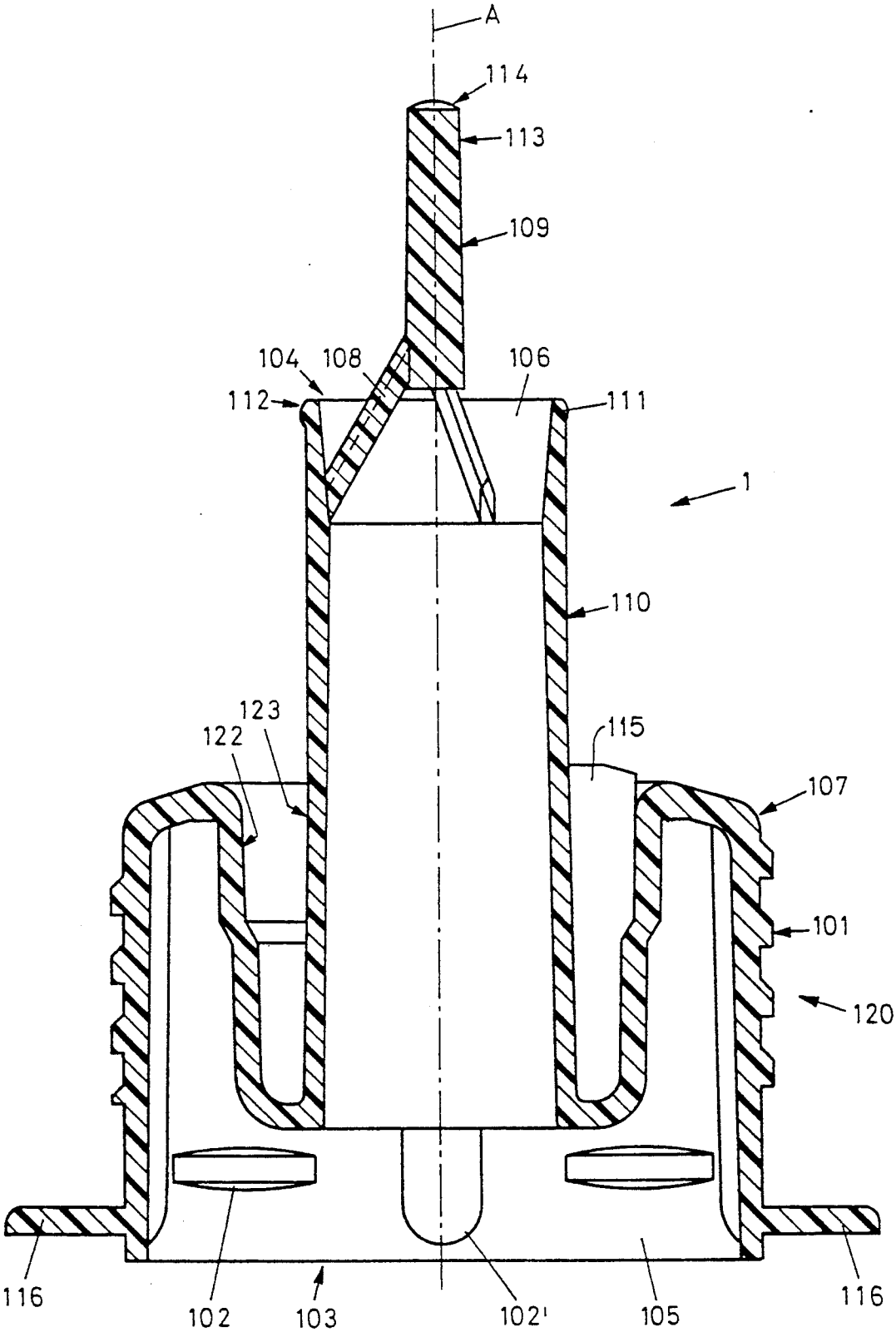
FIG. 3 shows the lower part of FIG. 1 as front view in the axial longitudinal section.
Figure 5:
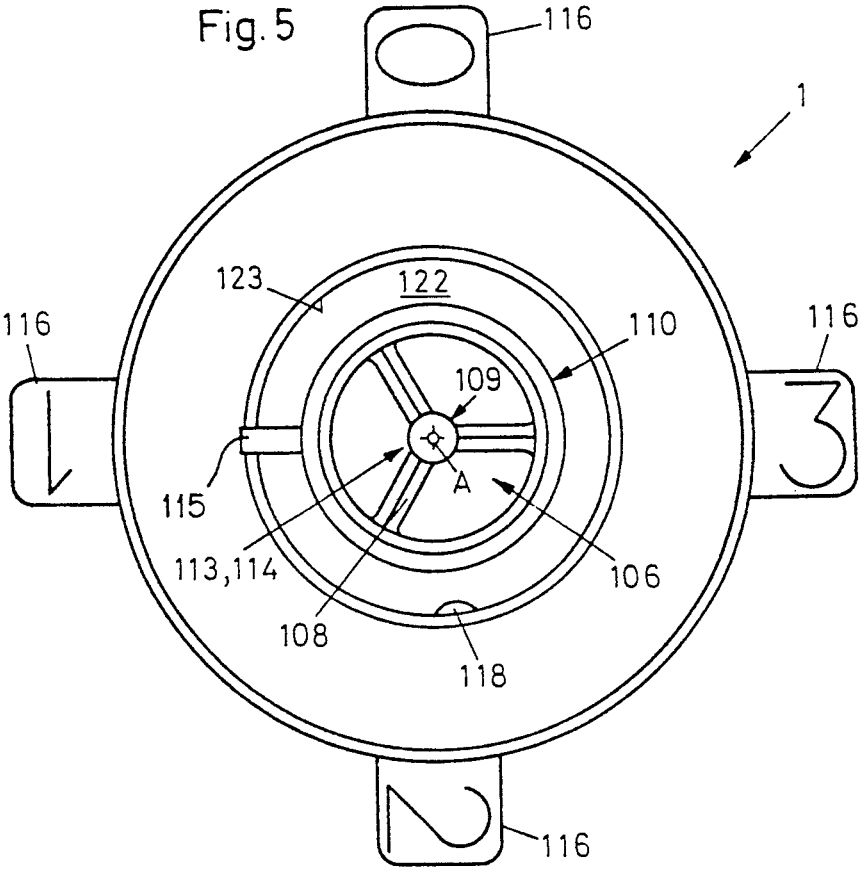
FIG. 5 shows the lower part of FIG. 1, seen from above.
Figure 6:
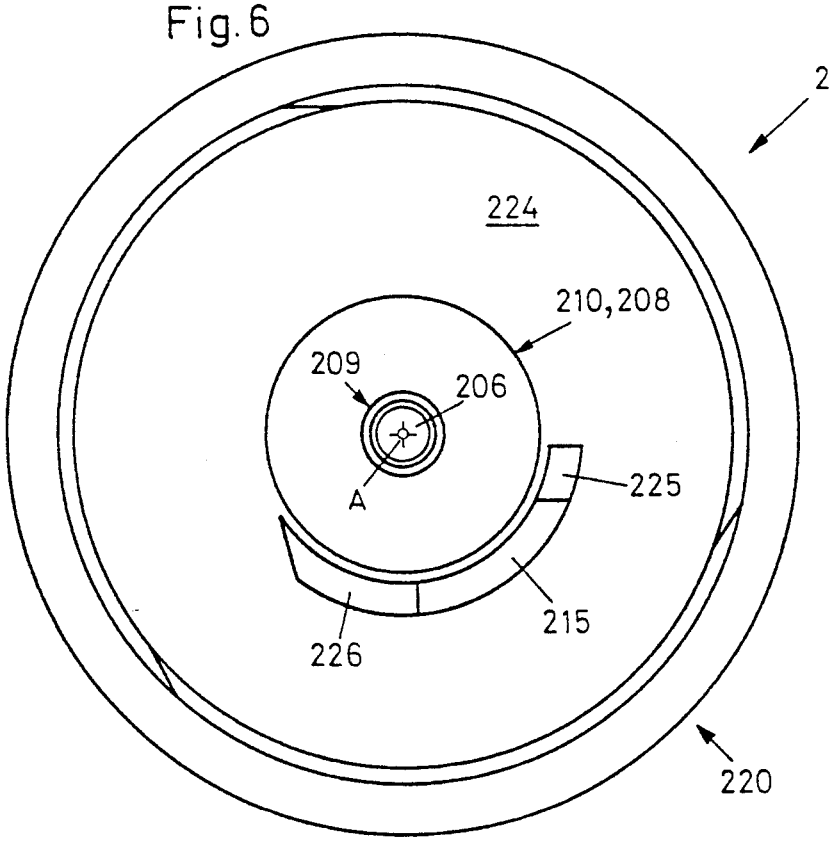
FIG. 6 shows the upper part of FIG. 2, seen from below.

A lower part 1 (see FIG. 1, 3 and 5) and an upper part 2 (see FIG. 2, 4 and 6) of the cap device according to the invention (see FIG. 7 and 8) are both essentially symmetrical in regard to an axis of symmetry A of the cap device. The lower part 1 and the upper part 2 are both made of synthetic material.

The lower part 1 comprises a screw cylinder 120 that can be mounted on a receptacle 127. The upper part of the receptacle 127 with a collar 128 can be seen in FIG. 7 and 8. For attaching the lower part 1 to the receptacle 127 a fastening organ 102, 102' is provided, for example in the form of clamping ribs 102 and retention ribs 102'.

Between a lower end 103 and an upper end 104 of the lower part 1 there is an in essence rotationally symmetrical, non-perforated surface area 107 which is continuous and tight. The surface area 107 ends at the lower end 103 by forming the margin of a lower opening 105, and at the upper end 104 by forming the margin of an upper opening 106. At the lower end 103 of the lower part 1 facing the receptacle, or in its proximity, there are for instance four marks 116 protruding outwards and arranged in regular intervals. These marks are for example developed as elements protruding outwards, however they could also be developed as embossed pattern visible from outside or in any other way. More marks or only one mark can be provided.

In the lower range or the lower part 1 there is an external thread 101 at the screw cylinder 120 for fastening and guiding of an internal thread 201 of the upper part 2.

Above the screw cylinder 120 a cylinder section 110 is located axially-symmetrically which near its upper end 112 is equipped with a sealing bulge 111. The sealing bulge 111 is fitted to the cylinder section 110 in the form of a swelling and from there is directed outwards radially.

The upper part 2 comprises a screw cylinder 220 that can be mounted on the screw cylinder of the lower part 1. The screw cylinder 220 can be embraced at the lower end by a not represented guarantee ring. In the mounted state of the seal and if it is fully screwed-on the guarantee ring acts jointly with projecting parts located at the lower part 1, in the present embodiment example with the four marks protruding outward 116, in order to prevent rotation of the upper part 2 in relation to the lower part 1 and thus an opening of the seal. Hence, the use of the receptacle's contents is prevented as long as the guarantee ring has not been removed. After the guarantee ring has been removed it can not be reinstalled at the seal.

Between a lower end 203 and an upper end 204 of the upper part 2 there is an in essence rotationally symmetrical, non-perforated surface area 207 which is also continuous and tight. The surface area 207 ends at the lower end 203 by forming the margin of a lower opening 205 and at the upper end 204 by forming the margin of an upper opening 206.

At the lower end 203 of the upper part 2 facing the receptacle or in its proximity there is for example a mark 216, 216' visible from the outside. In the represented embodiment example this mark is located at the approximately cylindrical external wall of the upper part 2 (mark 216) and essentially visible from above at an area of the upper part 2 (mark 216') directed towards the top. This mark is developed for example as embossed pattern visible from outside or above, but it could also be an element protruding outwards or have some other kind of design. One or more marks can be provided.

In order to make it possible for the user to ascertain the relative position or rotating position of the lower part 1 in regard to the upper part 2 the marks at the lower part 1 and at the upper part 2 are located in a way that they are facing each other in the mounted state of the seal. If the seal is screwed-on down to the stop at least one of the marks 116 applied at the lower part 1 will be facing one of the marks 216, 216' applied at the upper part 2.

In the lower portion of the upper part 2 the screw cylinder 220 is provided with an internal thread 201 for fastening and guiding in the external thread 101 of the lower part 1.

Above the screw cylinder 220 a cylinder section 210 is located axially-symmetrically which acts jointly with the sealing bulge 111 of the cylinder section 110 of the lower part 1 so as to guarantee good sealing between the lower part 1 and the upper part 2 against the inflow of air and the escape of the fluid contained in the receptacle.

In the mounted state of the seal the internal thread 201 is screwed onto the external thread 101 and thus effectively connected. As a consequence, the valve pin 109 can be displaced axially in relation to the valve tube 209 by rotating the upper part 2 in relation to the lower part 1. The two cylinder sections 110 and 210 embrace each other coaxially on at least part of their length, and they are axially displaced in relation to each other by rotation of the upper part 2 in regard to the lower part 1, however, the two cylinder sections remain permanently sealed in relation to each other.

An axially located valve pin 109 directed to the top is being held by means of three connecting bars 108 at the cylinder section 110 of the lower part 1 and above from it. The cylinder section 110, which in the mounted state of the seal is located inside, is therefore located in the middle range of the lower part 1 between the external thread 101 and the valve pin 109.

An axially located valve tube 209 is being held by means of an essentially conical intermediate piece 208 at the cylinder section 210 of the upper part and above from it. The cylinder section 210, which in the mounted state of the seal is located outside, is therefore located in the middle range of the upper part 2 between the internal thread 201 and the valve tube 209.

As a consequence, the upper ends 112 and 212 of the two cylinder sections 110 and 210 are facing one another at essentially the same level, if the seal has been mounted and is fully screwed-on.

The external thread 101 and the internal thread 201 together form a screw thread with a given lead which defines a stroke of the upper part 2 in relation to the lower part 1, according to the twisting angle of the upper part 2 in relation to the lower part 1.

The respective lengths of the valve pin 109 and of the valve tube 209 are dimensioned in a way that in the mounted state of the seal and if it is fully screwed-on the valve pin 109 is embraced coaxially by the valve tube 209 essentially at the entire length of the valve tube 209. On the other hand, the length of the valve pin 109 and the length of the valve tube 209 are dimensioned in regard to the stroke of the upper part 2 relative to the lower part 2 in a way that, in the mounted state of the cap device and if it is fully unscrewed, the valve pin 209 will lie essentially outside the valve tube 209.

At the upper end of the valve pin 109 a sealing piece 113 is provided which is fitted to it axially as an extension of the valve pin 109. In the mounted state of the cap device and if it is fully screwed-on the upper opening 206 of the upper part 2 is stopped by the sealing piece 113.

Both valve pin 109 and valve tube 209 are truncated. Both are tapering towards the upper opening 206 of the upper part 2 (when considered in the mounted state of the cap device). The cone angle of the valve pin 109 is more acute than the cone angle of the valve tube 209 so that in the mounted state of the seal and if it is fully screwed-on the valve pin 109 will always be at a distance from the valve tube 209. This makes a controllable opening of the valve composed of valve pin 109 and valve tube 209 easier.

Figure 1:
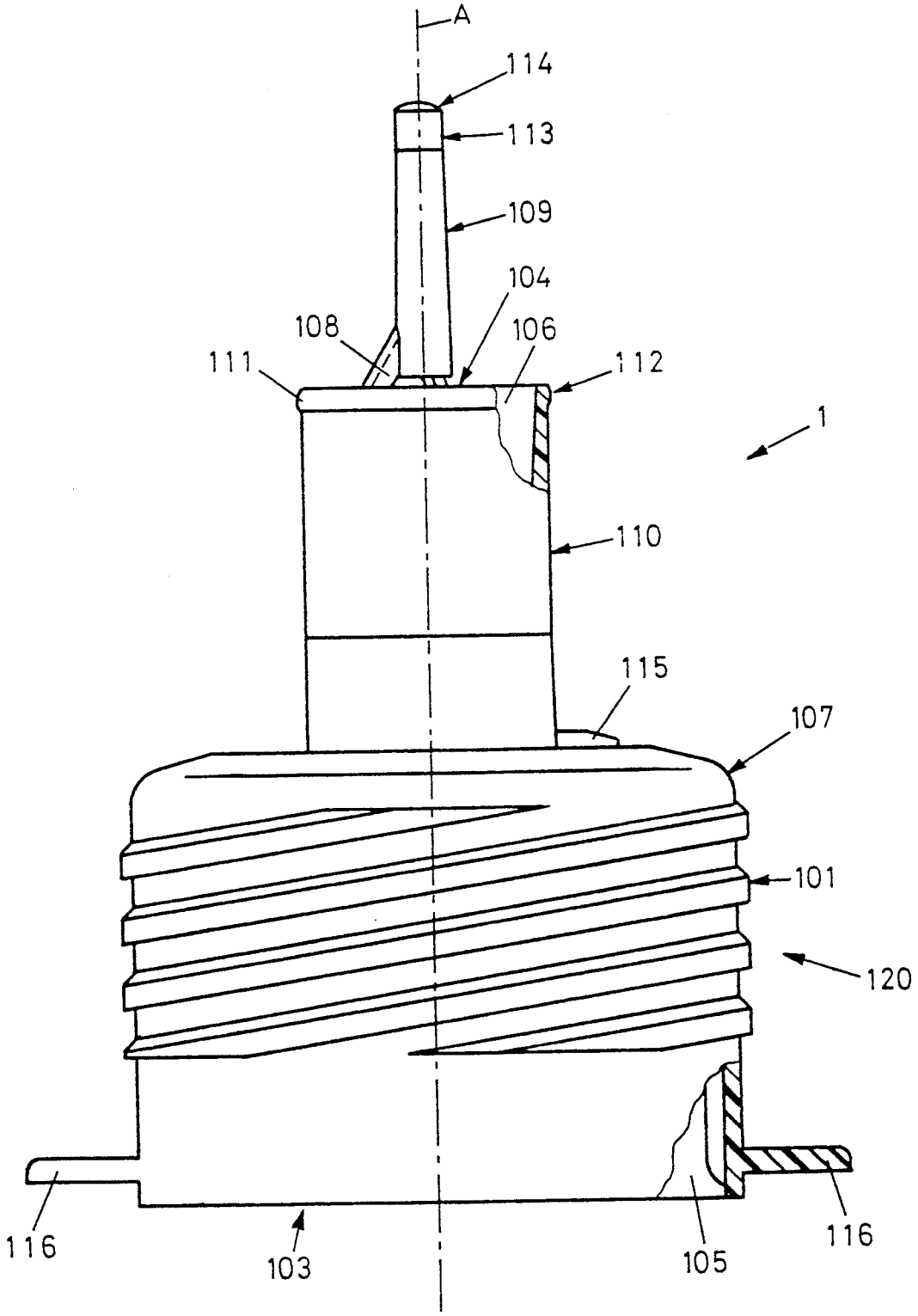
FIG. 1 shows a lower part of the seal according to the invention in a partly sectional front view.
Figure 7:
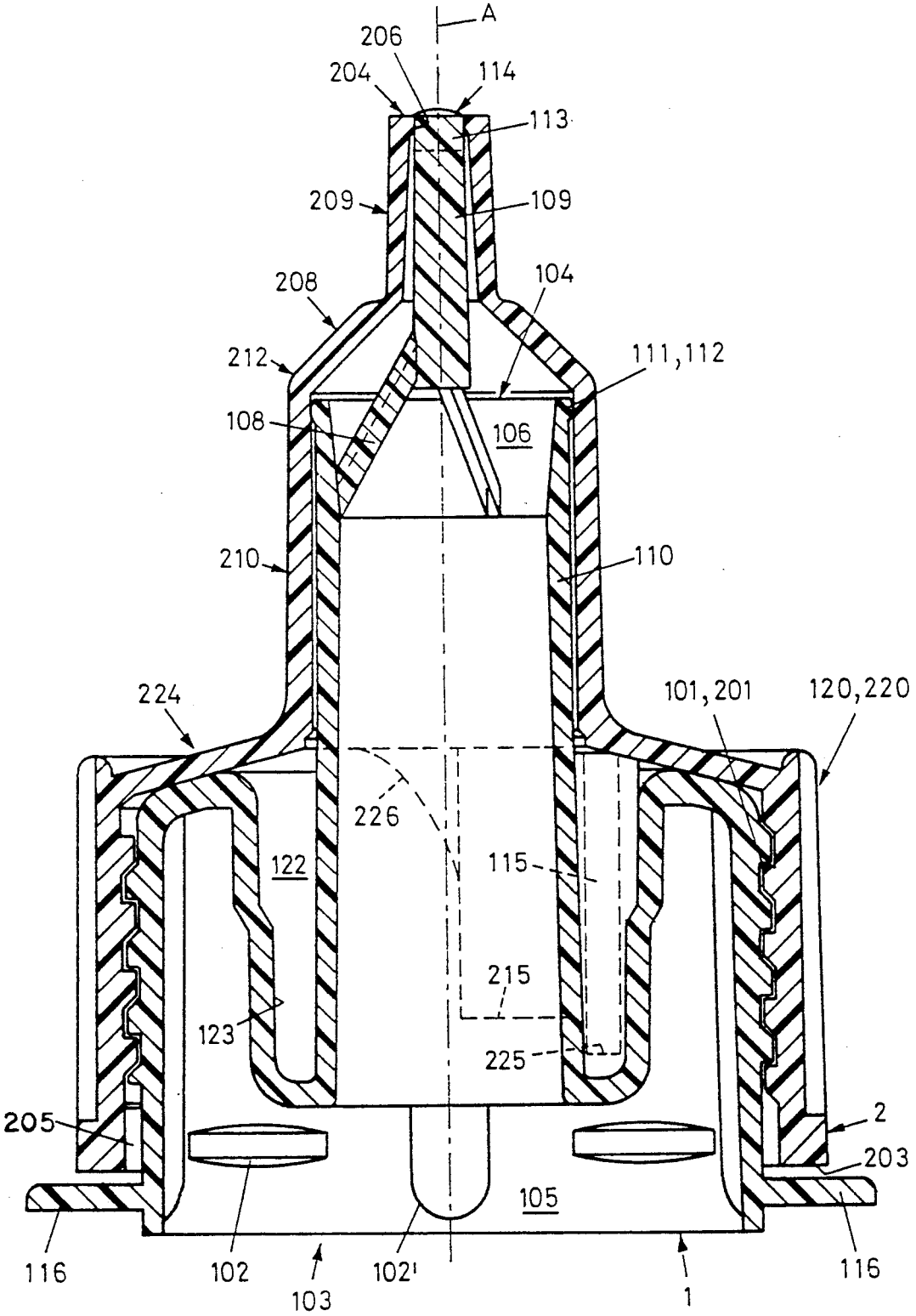
FIG. 7 shows the entire seal according to the invention in the screwed-on state, as a section, with a first special development of the sealing piece.
Figure 8:
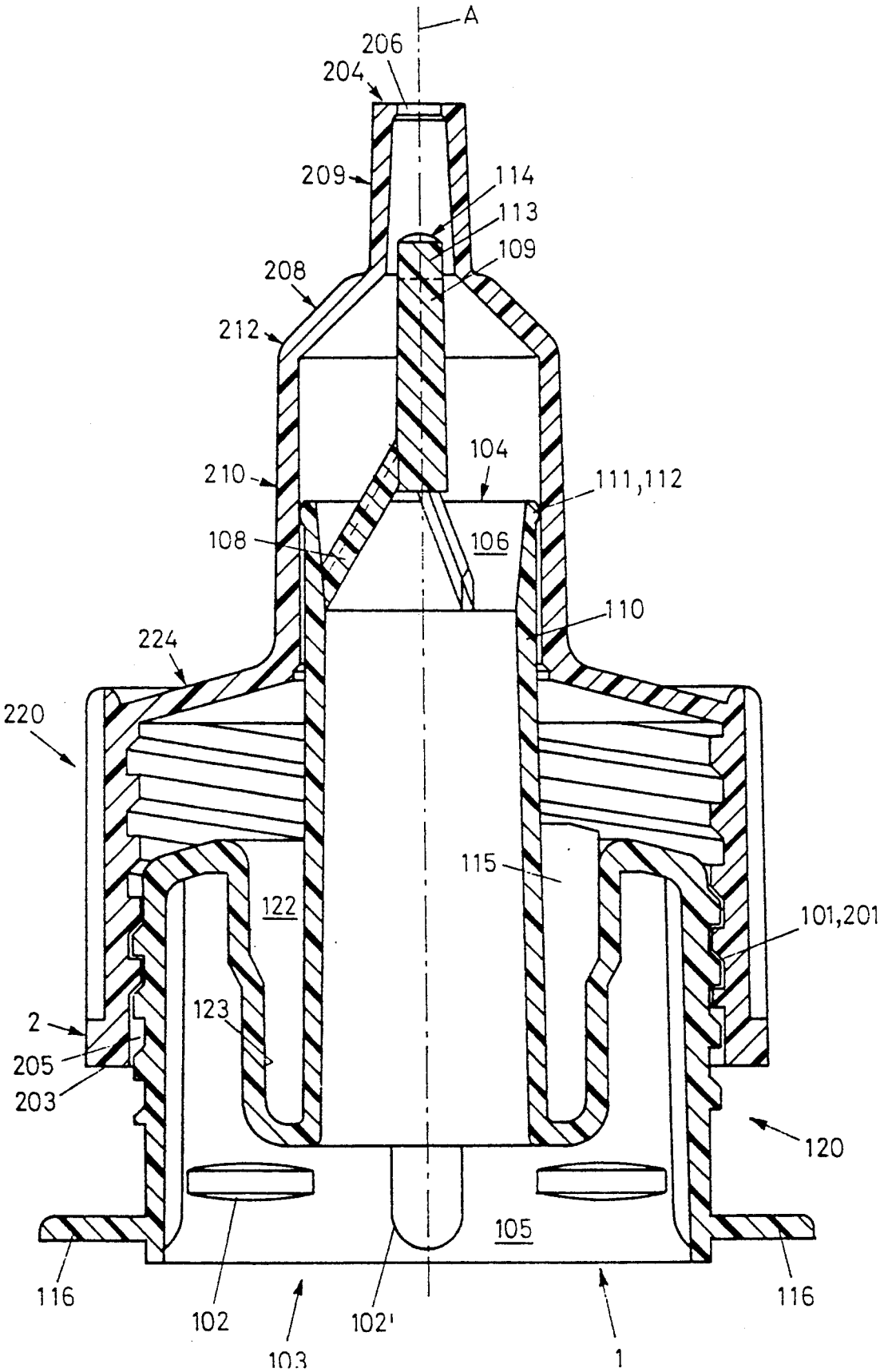
FIG. 8 shows the entire seal according to the invention in the unscrewed state, as a section.

The sealing piece 113 may be developed in a cylindrical shape as shown in the embodiment represented in FIG. 1, 7 and 8. As in an embodiment represented in FIG. 3 the sealing piece 113 may also be developed as steady conical extension of the conical valve pin 109.

In the embodiment shown in FIG. 1 through 8 the length of the sealing piece 113 is dimensioned approximately as long as the thickness of the upper part 2 at its upper end 204 in the area of its upper opening 206. Thus an upper end 114 of the sealing piece 113 is about flush with the upper end 204 of the upper part 2 if the cap device is in the mounted state and fully screwed-on, this signifies that the sealing piece 113 will not protrude axially by much.

Figure 9:
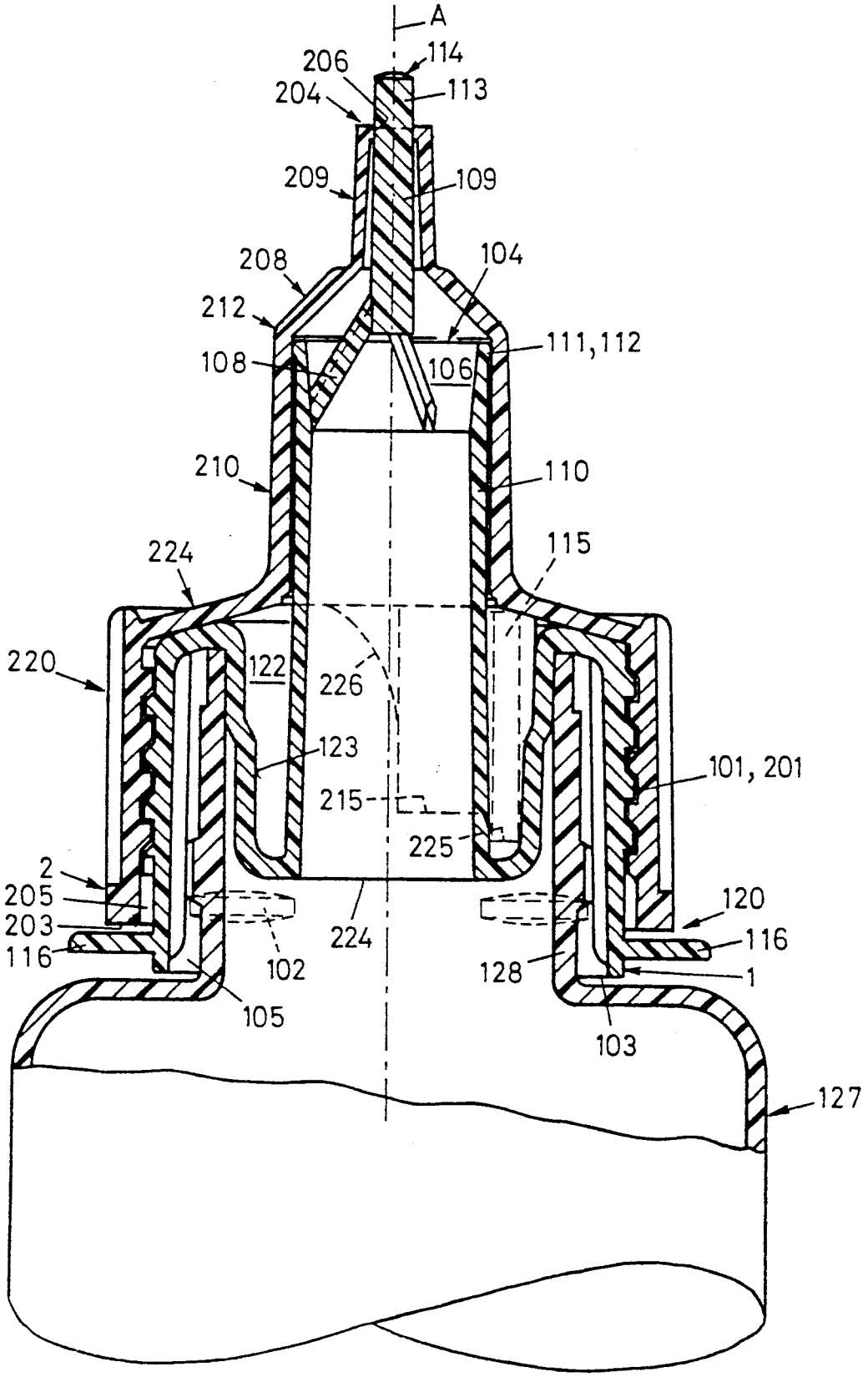
FIG. 9 shows the entire seal according to the invention in the screwed-on state as in FIG. 7 and the upper part of a receptacle where the seal is mounted, as a section, with a second special development of the sealing piece.

In the embodiment according to FIG. 9 the sealing piece 113 is dimensioned as being longer than the thickness of the upper part 2 at its upper end 204 in the area of its upper opening 206. Thus, in FIG. 9 an upper end 114 of the sealing piece 113 rises above the upper end 204 of the upper part 2 in the mounted state of the cap device and if it is fully screwed-on, this signifies that the sealing piece 113 will then protrude axially by a predetermined projecting height.

Figure 4:
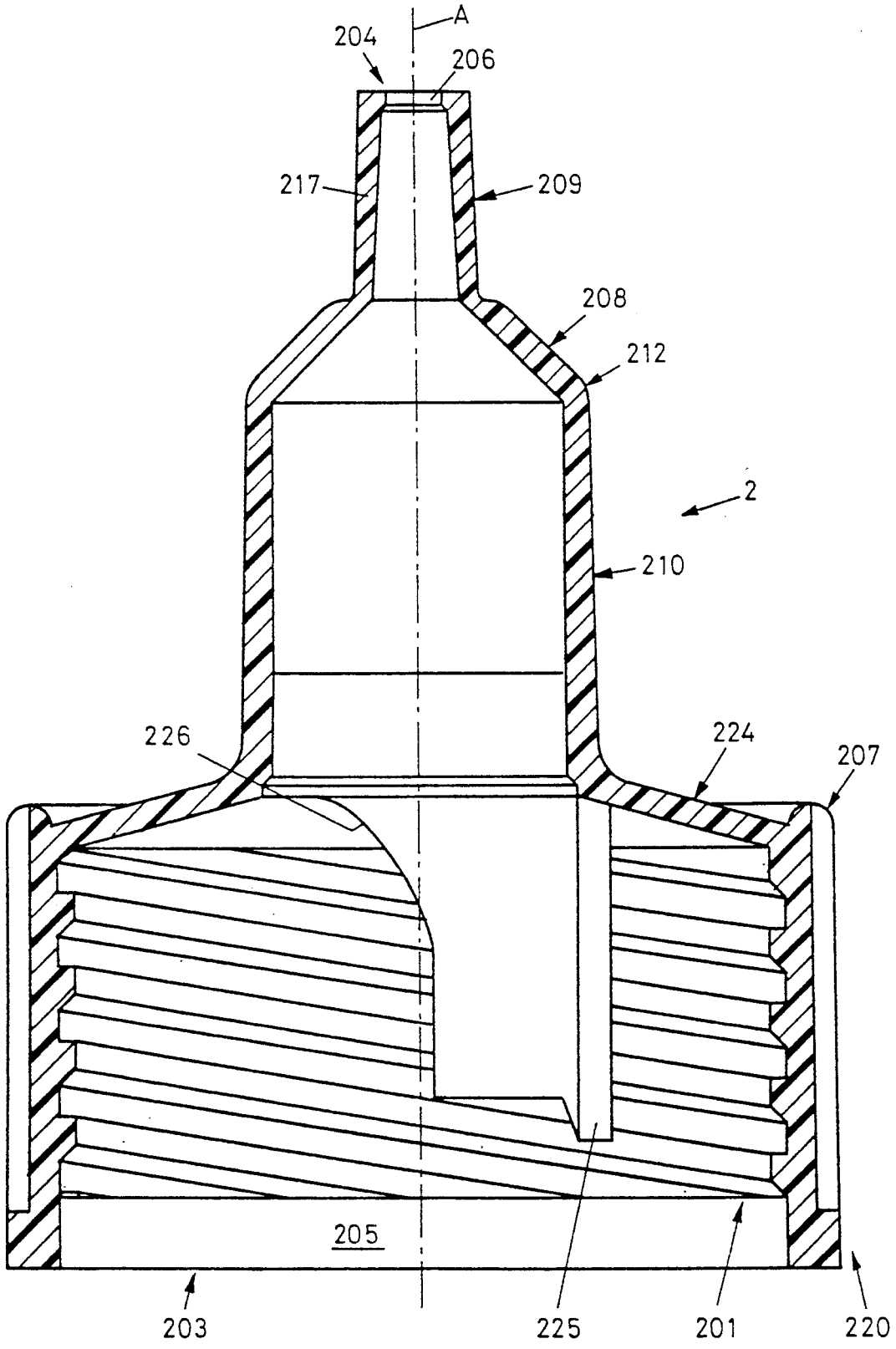
FIG. 4 shows the upper part of FIG. 2 as front view in the axial longitudinal section.

For better sealing the diameter of the sealing piece 113 at the lower part 1 is by 0.01 to 0.25 mm greater than the diameter of the upper opening 206 at the upper part 2. In the mounted state of the cap device and if it is unscrewed down to the stop, the sealing piece 113 may only be introduced into the upper opening 206 against the action of elasticity of the synthetic material. In order to make this possible, the synthetic material has been chosen accordingly in regard to its elasticity. For facilitating the introduction of the sealing piece 113 into the upper opening 206 latter may be equipped with a conical enlarging at its lower end as can be seen in FIG. 4.

In order to facilitate the connecting of the cap device with an external device such as hose, needle, etc. an outer wall 217 of the valve tube 209 is developed as standard cone, for example as Luer cone.

At the lower part 1 the axially installed cylinder section 110 projects into the screw cylinder 120 with radial distance, in a way that an bulge-in 122 with an essentially cylindrical inner area 123 is formed between the screw cylinder 120 and the cylinder section 110. At this cylindrical inner area 123 of the bulge-in 122 a rib 115 is located, lying parallel to axis A, directed radially inwards and at a distance from the axis A. For reasons of manufacture and stability and for making assembly easier the rib 115 is developed as flat wall which divides up the bulge-in 122 by connecting the cylinder section 110 with the cylindrical inner area 123.

At the upper part 2, approximately as an extension of the cylinder section 210, there is a baffle 215 directed towards the bottom, lying parallel to the axis A and situated at a distance from the axis A and developed essentially as a combination of a full sector and the remaining gap of a cylindrical surface area. For reasons of manufacture and stability and for making assembly easier the baffle 215 is equipped with a point pointing towards the bottom at its lower end in the proximity of the edge which is up front when screwing-on and with a tail-like enlarging at its upper end in the proximity of the edge which is in back when screwing-on.

In the mounted state of the cap device the rib 115 and the baffle 215 act jointly as to limit the rotation of the upper part 2 in relation to the lower part 1 by stopping one another. In principle, the twisting angle of the upper part 2 in relation to the lower part 1 tolerated by rib 115 and baffle 215 is smaller than a full revolution, in the represented embodiment example the width of the rib 115 and the arc length of the baffle 215 have been selected in a way that the tolerated twisting angle is about three-quarters of a revolution.

With this tolerated twisting angle the corresponding stroke of the upper part 2 in relation to the lower part 1 in the embodiment shown in FIG. 1 through 8 is dimensioned in a way that the sealing piece 113, if the cap device is mounted and fully screwed-on, just stops the upper opening 206, in a way that the upper end 114 of the sealing piece 113 in the axial direction is about flush with the upper opening 206.

In the embodiment represented in FIG. 9 the stroke of the upper part 2 in relation to the lower part 1 is longer that the sum of the thickness of the upper part 2 (at its upper end 204 in the range of its upper opening 206) and the projecting height of the sealing piece 113 (above the upper end 204 of the upper part 2 in the mounted state of the seal and if it is fully screwed-on). This guarantees that the sealing piece 113 travels fully through the upper opening 206 also with the twisting angle limited by rib 115 and baffle 215, if the cap device is mounted and fully screwed-on, in a way that the upper end 114 of the sealing piece 113 is located in the axial direction above the upper opening 206.

On the other hand, the length of the sealing piece 113 when taking into consideration the stroke of the upper part 2 in relation to the lower part 1 in the case of this tolerated twisting angle is always dimensioned in a way that in the mounted state of the cap device and if it is unscrewed down to the stop the upper end 114 of the sealing piece 113 is pulled back from the upper opening 206 and from most of the valve tube 209. Then, the upper opening 206 and most of the valve tube 209 are set free for the passage of the free-flowing substance contained in the receptacle.

At the lower part 1 a cam is provided 118 which is located at the cylindrical inner area 123 of the bulge-in 122 at a distance from the axis A and parallel to it and which is directed radially to the inside. The length of the cam 118 in the parallel direction to the axis A is dimensioned in a way that the cam 118 acts jointly with the baffle 215 if the seal is mounted an set to a position between fully screwed-on and at the most one-fourth unscrewed. The joint action of the cam 118 with the baffle 215 consists in a friction which is surmountable against the action of the elasticity of the material and which hampers a rotation of the upper part 2 relative to the lower part 1.

The FIG. 7 and 8 show the entire cap device according to the invention in the axial longitudinal section.

FIG. 7 and 9 show the cap device in the closed state, FIG. 9 also showing a receptacle 127. By means of the external thread 101 and the internal thread 201 as guiding and fastening mechanism the upper part 2 is screwed down entirely to the lower part 1. The receptacle 127 is held at its collar 128 by means of the fastening organ 102 in the lower part 1 of the seal, 102' consisting of clamping ribs and retention ribs 102'. The baffle 215 is at a stop at the rib 115. It is especially visible how the upper opening 206 is penetrated by the sealing piece 113 and thus entirely closed, how the valve pin 109 is fully enclosed by the valve tube 209 and fills it to a large degree and how the upper end 114 of the sealing piece 113 in FIG. 7 is flush with the upper opening 206 and protrudes in FIG. 9 from the upper opening 206. The proportioning area between the lower part 1 and the upper part 2 extends in the axial direction from the sealing by the swelling 111 between the cylinder sections 110 and 210 to the sealing between the sealing piece 113 and the upper opening 206 against the action of the elasticity of the material.

The proportioning area is absolutely tight against the outside air and of a very small volume. It contains before and after the first use of the cap device a free-flowing substance or for example a gas from the receptacle 127 stemming from the production of the cap device which can be a protective gas that was introduced together with the filling of the receptacle 127.

FIG. 8 shows the cap device in its opened state. By means of the external thread 101 and the internal thread 201 as guiding and fastening, the upper part 2 is entirely screwed onto the lower part as far as this is possible. The receptacle 127 is held with its collar 128 by the fastening organ 102, 102' located in the lower part 1 of the cap device and consisting of clamping ribs 102 and retention ribs 102'. The baffle 215 in turn is at a stop at the rib 115, however, in the situation of FIG. 8 at the other side of the rib 115 and with its other edge than in the situation of FIG. 7. This stop prevents a complete unscrewing, lifting-off and removing of the upper part 2 from the lower part 1. It is especially visible how the upper opening 206 is fully open and set free by the sealing piece 113, how the upper end 114 of the sealing piece 113 is pulled back from the upper opening 206 and the valve pin 109 from the valve tube 209. The proportioning area between the lower part 1 and the upper part 2 may be passed freely by the free-flowing substance from the receptacle 127 through the upper opening 106 of the lower part. The outside air is only in contact with the substance from the receptacle 127 at the upper opening and will not get into contact with the substance in the receptacle 127 as long as there is overpressure within the receptacle, i.e. as long as the receptacle—if rigid—is subject to gas pressure or piston force or—if flexible—is pressed by hand.

In an intermediate position between the situations of FIG. 7 and 8 the upper opening 206 is set free to a large degree or fully from the sealing piece 113, however, the valve pin 109 is only partly enclosed by the valve tube 209 and fills it partly, depending on the twisting angle of the upper part 2 in relation to the lower part 1. This very dependency renders possible a fine, continuously adjustable proportioning of the throughput of the free-flowing substance from the receptacle 127 through the cap device according to the invention. In the course of this process, the joint action of the cam 118 and the baffle 215 results in a friction which impedes an undesired rotation of the upper part 2 in relation to the lower part 1 and which brakes an intentional rotation. the latter in order to prevent that substances or gases contained in the receptacle can escape abruptly and constitute a hazard for the user.

What is claimed is:

1. A two-part captive dispensing cap device for use with a container, which comprises:

a lower part slidable onto a container and rotationally symmetrical about a longitudinal axis of the cap device, a lower portion of the lower part having an inner side and an outer side where the outer side includes a plurality of external threads and the inner side of the lower portion of the lower part includes an organ which attaches to the container, the lower part defining a substantially central longitudinal aperture therethrough and including an upper end and a lower end each having an opening communicating with the longitudinal aperture, the lower part further including a non-perforated surface area extending between the upper and lower ends consistent with the longitudinal aperture and substantially centered about the longitudinal axis of the cap device;

an upper part substantially symmetrical around the axis of the cap device and including a lower portion having an inner side and an outer side, the inner side having a plurality of internal threads designed and configured for mating with the external threads of the lower part, the upper part further defining a longitudinal aperture which extends therethrough and being substantially centered about the longitudinal axis of the cap device, the upper part including an upper end a lower end each having an opening communicating with the longitudinal aperture, the upper part including a non-perforated surface area between the upper and lower ends;

a valve pin extending substantially upwards from the upper end of the lower part and positioned about the longitudinal axis of the cap device and held in a substantially stationary position by at least two connecting bars coupled at one end to the valve pin and at an opposite end connected proximal the upper end of the lower part;

a valve tube extending substantially upwards from the upper end of the upper part and positioned about the longitudinal axis of the cap device, the valve tube being integral with an intermediate conical portion attached to the upper end of the upper part, the valve pin cooperates with the valve tube and the internal threads of the upper part cooperate with the external threads of the lower part when the upper and the lower part are in the mounted state to axially displace the valve pin in relation to the valve tube by turning the upper part in relation to the lower part;

an upper cylinder section positionable about the longitudinal axis of the cap device between the lower end and the upper end of the upper part, the cylinder section being integral with the lower end of the upper part and integral with the intermediate conical portion of the upper part;

a lower cylinder section positionable about the longitudinal axis of the cap device between the lower end and the upper end of the lower part;

a sealing bulge positioned about the upper end of the lower part and substantially circumferentially continuous about the upper end and extending radially outward towards an inner side of the upper cylinder section of the upper part when the upper and lower parts are in a mounted state such that the sealing bulge of the lower part substantially communicates with the inner side of the upper cylinder section of the upper part when the upper and lower parts are mounted such that a substantial seal is provided continuously along the upper cylinder section of the upper part when the upper and lower cylinder sections are displaced axially in relation to each other, the upper part and the lower part communicating such that the internal threads of the upper part and the external threads of the lower part cooperate such that the upper part rotates and elevates itself or lowers itself in relation to the lower part, and when the upper part is in its lowest position respective to the lower part the upper ends of the upper part upper cylinder section and the lower part lower cylinder section are facing each other along a portion of the axis and the valve tube and the valve pin substantially communicate along their respective lengths, and when the upper part is at a most elevated position with respect to the lower part the valve pin and the valve tube are not axially coextensive; and a sealing piece positioned at an upper end of the valve pin is axially positioned above the valve pin, such that when the upper part is mounted on the lower part and when the upper part is in its lowest position relative to the lower part the sealing piece is introduced into the upper part of the valve tube;

a rib located at the lower part parallel to the axis and at a distance from it and directed, upward and a baffle located at the upper part parallel to the axis and at a distance from it and directed downward, the rib and the baffle acting jointly in the mounted state of the cap device in order to limit the possible rotation of the upper part relative to the lower part, by means of stopping each other at a twisting angle which is smaller than a full revolution; and the lower part being equipped with a cam located parallel to the axis and at a distance from it and directed radially inward which, in the mounted state of the cap device and when it is in a position between being fully screwed-on and at the most one-fourth unscrewed, acts jointly with the baffle in order to surmountably impede a rotation of the upper part in relation to the lower part against the action of the elasticity of the material.

2. A cap advice according to claim 1, characterized in that the valve pin and the valve tube are both truncated cones and, when considered in the mounted state of the cap device, are tapering towards the upper opening of the upper part, the valve pin having a more acute cone angle than the valve tube, and that in the mounted state of the cap device and when the upper part is positioned lowest with respect to the lower part an outer surface of the valve pin is located at an axial distance from an inner surface of the valve tube.

3. A cap device according to claim 1, further comprising in a mounted state, unscrewed to such a position that the sealing piece of the valve pin does not cooperate with the opening provided at the upper end of the valve tube the sealing piece having a generally cylindrical shape and a diameter greater by 0.01 to 0.25 mm than the diameter of the upper opening, and an elasticity of the upper and lower parts is such that the sealing piece may be introduced into the upper opening against the action of the elasticity of the material.

4. A cap device according to claim 1, characterized in that the sealing bulge is designed as swelling fitted onto the lower cylinder section.

5. A cap device according to claim 1, characterized in that an external wall of the valve tube is designed as cone corresponding to a predetermined nozzle cone of a standard nozzle-to-funnel cone connection.

6. A cap device according to claim 5, characterized in that the standard cone is a Luer cone.

7. A cap device according to claim 1, wherein, in a mounted state unscrewed to such a position such that the valve pin does not cooperate with an opening provided at the upper end of the valve tube, the sealing piece has a generally conical shape and a diameter that is greater by 0.01 to 0.25 mm than the diameter of the upper opening, and the elasticity of the synthetic material of the upper and lower parts is such that the sealing piece may be introduced into the upper opening against the action of the elasticity of the material.

* * * * *